United States Patent [19]

Marchione

[11] Patent Number: 5,054,165

[45] Date of Patent: Oct. 8, 1991

[54] DOOR ON-DOOR OFF VEHICLE HINGE WITH HOLD-OPEN MECHANISM

[75] Inventor: Joseph H. Marchione, Rockford, Ill.

[73] Assignee: Atwood Industries, Inc., Rockford, Ill.

[21] Appl. No.: 432,234

[22] Filed: Nov. 6, 1989

[51] Int. Cl.[5] ..... E05D 7/12

[52] U.S. Cl. ..... 16/270; 16/254; 296/146

[58] Field of Search ..... 16/254, 270, 271, 332, 16/354, 264, 261, 270; 296/146

[56] References Cited

U.S. PATENT DOCUMENTS

| | | | |
|---|---|---|---|
| 2,812,536 | 11/1957 | Raysdale | 16/332 |
| 2,992,452 | 7/1961 | Schonitzer | 16/141 |
| 3,370,317 | 2/1968 | Marchione | 16/145 |
| 4,619,016 | 10/1986 | Brockhaus | 16/383 |
| 4,720,895 | 1/1988 | Peebles | 16/264 |
| 4,807,331 | 2/1989 | Calucci | 16/272 |
| 4,864,687 | 9/1989 | Calcaterra et al. | 16/270 |

FOREIGN PATENT DOCUMENTS

| | | | |
|---|---|---|---|
| 1909335 | 9/1970 | Fed. Rep. of Germany | 16/334 |

*Primary Examiner*—Lowell A. Larson
*Assistant Examiner*—Michael J. McKeon
*Attorney, Agent, or Firm*—Leydig, Voit & Mayer

[57] ABSTRACT

A hinge for mounting a vehicle door for swinging between open and closed positions on a vehicle body. The hinge includes a door section adapted to be attached rigidly to the door, a body section adapted to be attached rigidly to the body, and an intermediate section pivotally connected to the body section and detachably connected to the door section to enable the door to be quickly removed from and re-installed on the body. To facilitate such removal and re-installation, the door section of the hinge carries a pin which is adapted to hang in a notch in the intermediate section to support, locate and stabilize the door as it is being removed and re-installed. The body section and the intermediate section of the hinge carry components of a plunger-type hold-open mechanism which releasably holds the door in partially open and nearly fully open positions and which remains in its entirety with the vehicle body when the door is removed.

19 Claims, 3 Drawing Sheets

DOOR ON-DOOR OFF VEHICLE HINGE WITH HOLD-OPEN MECHANISM

BACKGROUND OF THE INVENTION

This invention relates to a hinge for mounting the door of a vehicle for swinging between open and closed positions on the body of the vehicle. Such a hinge conventionally includes a door section adapted to be connected rigidly to the door and pivotally interconnected with a body section which is adapted to be connected rigidly to the body.

A vehicle door hinge usually is equipped with a hold-open mechanism which retains the door releasably in both a partially open position (i.e., an intermediate position) and in a fully open or nearly fully open position. A popular hinge with a hold-open mechanism is disclosed in Marchione U.S. Pat. No. 3,370,317. In that hinge, a torsion bar is utilized to produce the hold-open action. The torsion bar hold-open, however, is bulky and has a tendency to squeak as the door is opened and closed.

Schonitzer U.S. Pat. No. 2,992,452 also discloses a vehicle hinge with a hold-open mechanism. The Schonitzer hinge relies on a spring-loaded plunger for hold-open purposes but, like the hinge of the Marchione '317 patent, the Schonitzer hinge is bulky and takes up a significant amount of space in both the lateral and longitudinal directions.

Recent developments in vehicle hinges involve a "door on-door off" principle which is disclosed in Brockhaus U.S. Pat. No. 4,619,016. In accordance with this principle, the door is fully installed on the vehicle body at one stage of an assembly line and, during such installation, the door and body sections of the hinge are adjusted as necessary to achieve a proper fit between the door and the body. Thereafter, the door is removed from the body by disassembling the hinge but without disturbing the positional relationship between the door and the door section of the hinge and between the body and the body section of the hinge. A door on-door off hinge is designed in such a manner that, when the hinge is re-assembled at a later stage of the assembly line, the positional relationship or fit between the vehicle door and body is the same as was established earlier during the adjustment stage. In this way, the door can be installed and adjusted at one point along an assembly line, the door can be removed to facilitate painting or other assembly operations, and then the door can be quickly and easily re-installed without need of further adjustment of the door relative to the body.

SUMMARY OF THE INVENTION

The general aim of the present invention is to provide a new and improved door on-door off hinge which, when compared with prior hinges, can be disassembled and re-assembled in a quicker and easier manner and which, in addition, includes a simple, compact and relatively noise-free hold-open mechanism that remains in its entirety with the vehicle body when the door is removed.

A more detailed object of the invention is to achieve the foregoing through the provision of a hinge which includes an intermediate hinge section as well as door and body sections. During disassembly and re-assembly of the hinge, the door may be hung in suspended relation from the intermediate hinge section so as to avoid the need for stabilizing the door and holding the door against gravity. The intermediate hinge section carries a major component of the hold-open mechanism and eliminates the need of disassembling any part of the hold-open mechanism when the door is removed from the body.

These and other objects and advantages of the invention will become more apparent from the following detailed description when taken in conjunction with the accompanying drawings.

DETAILED DESCRIPTION OF THE PREFERRED EMBODIMENTS

Figure 1:
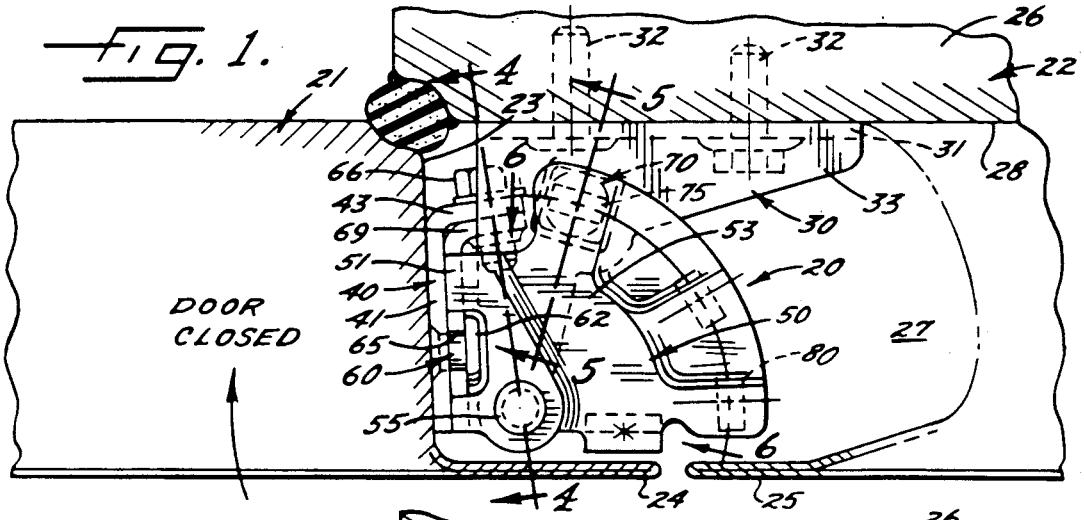
FIG. 1 is a top plan view showing one embodiment of a new and improved hinge incorporating the unique features of the present invention, the hinge being shown as installed in a vehicle with the door of the vehicle being illustrated in a closed position.
Figure 2:
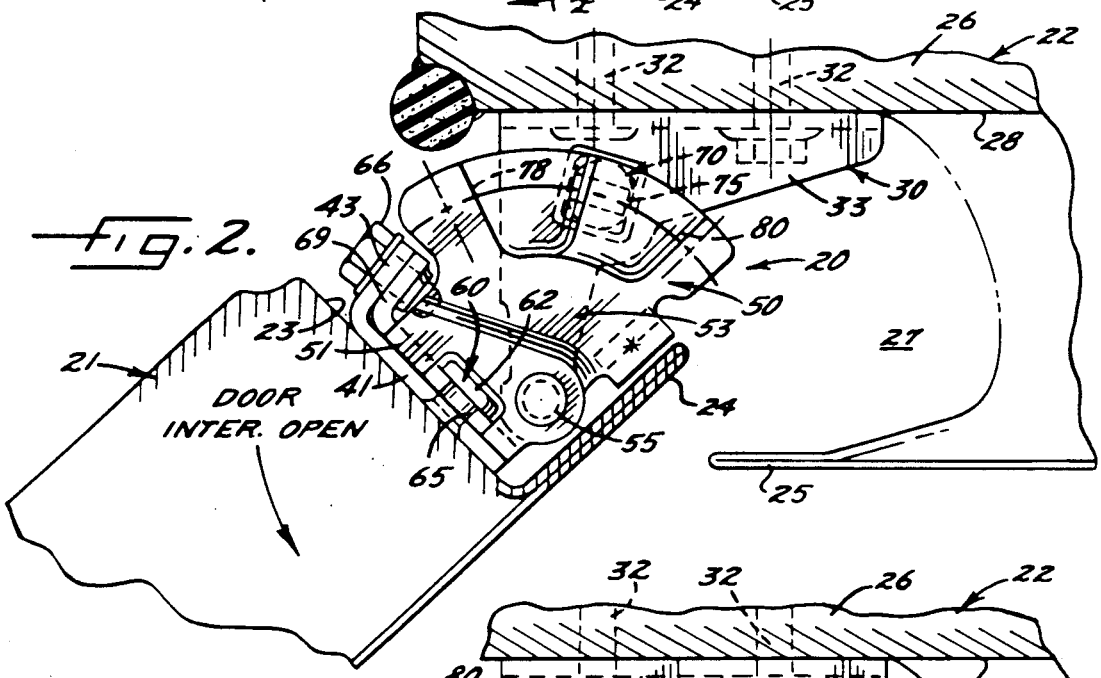
FIG. 2 is a view similar to FIG. 1 but shows the door in a partially open position.
Figure 3:
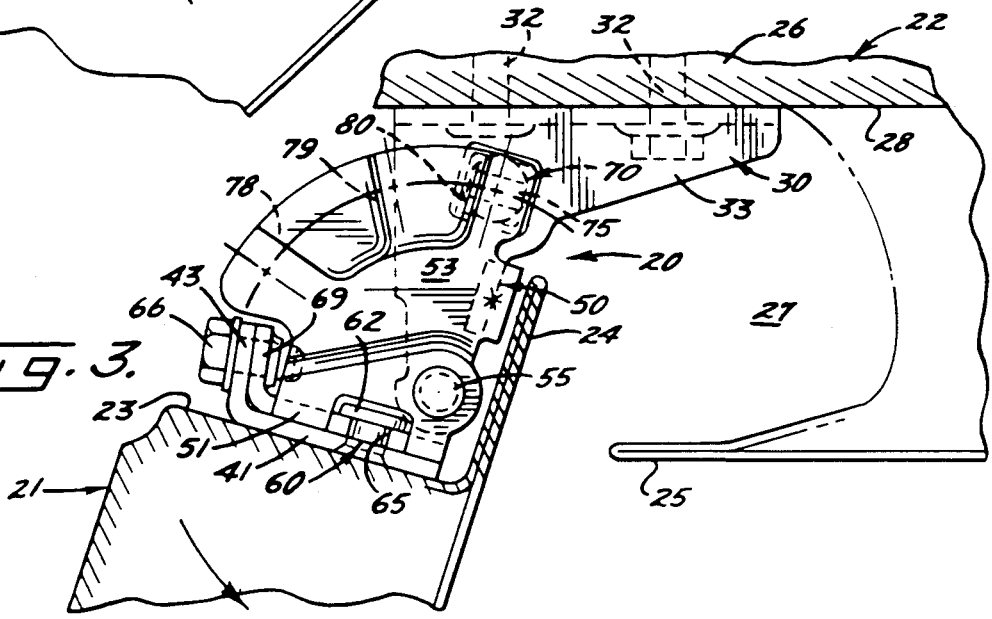
FIG. 3 is also a view similar to FIG. 1 but shows the door in a nearly fully open position.

As shown in the drawings for purposes of illustration, the invention is embodied in a hinge 20 for mounting a vehicle door 21 for swinging about an upright axis and between open and closed positions on a vehicle body 22. The door which has been illustrated is a right-hand front door and includes a forwardly facing and laterally extending hinge-mounting wall 23. A sheet metal panel 24 extends forwardly from the outer side of the door and helps conceal the hinge from view from outside the vehicle. When the door 21 is closed, the hinge is also concealed from view by a rearwardly extending sheet metal panel 25 which forms part of a front fender. The fender and a body frame member 26 coact to define a cavity or well 27 which receives part of the hinge. One side of the frame member faces laterally outwardly and defines a hinge-mounting wall 28 which extends generally perpendicular to the wall 23 when the door is in a closed position.

The hinge 20 includes a body section 30 (FIGS. 4 and 5) which is anchored rigidly to the frame member 26. Specifically, the body section is stamped from a single piece of sheet metal and includes an upright web 31 which is disposed in face-to-face relation with the wall 28 of the frame member. Screws 32 extend through oversize holes (not shown) in the web 31 and are threaded into the frame member 26 to attach the body section 30 of the hinge 20 to the vehicle body 22.

Figure 4:
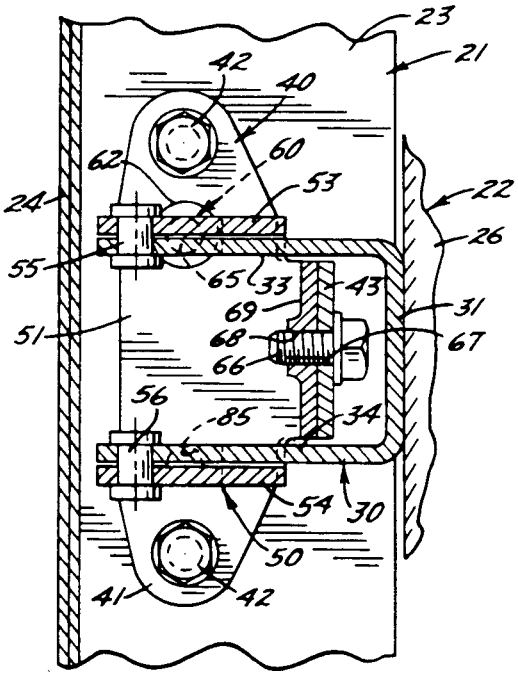
FIGS. 4, 5 and 6 are fragmentary cross-sections taken substantially along the lines 4—4, 5—5 and 6—6, respectively, of FIG. 1.

As shown in FIG. 4, the body section 30 of the hinge 20 is generally U-shaped when viewed in an upright plane extending laterally of the vehicle. Identical upper and lower plates 33 and 34 are formed integrally with the upper and lower margins, respectively, of the web 31 and extend laterally outwardly from the web. Each plate is generally L-shaped when viewed from above.

The hinge 20 also includes a door section 40 (FIGS. 4 and 7) having an upright sheet metal web 41 which lies in face-to-face relation with the mounting wall 23 of the door 21. The door section 40 is anchored rigidly to the door 21 by screws 42 (FIG. 4) extending through oversize holes (not visible) in the web 41 and threaded into the wall 23. For a purpose to be described subsequently, a forwardly projecting flange 43 is formed integrally with the inner margin of the web 41 midway between the upper and lower ends thereof. The flange 43 extends generally perpendicular to the web 41.

In accordance with one aspect of the present invention, the body and door sections 30 and 40 are connected by an intermediate hinge section 50 which enables the door 21 to be removed from and re-installed on the body 22 in an extremely quick and easy manner. The hinge 20 is particularly characterized in that the door is adapted to hang in suspended relation from the intermediate hinge section 50 in such a manner that the latter hinge section stabilizes the door and supports its weight as the door is removed from and re-installed on the body.

More particularly, the intermediate hinge section 50 includes an upright web 51 (FIG. 4) stamped from sheet metal and adapted to be located in face-to-face relation with the forward side of the web 41 of the door section 40. Formed integrally with the upper and lower margins of the web 51 are upper and lower plates 53 and 54, respectively, which extend forwardly when the door 21 is in its closed position. As shown most clearly in FIG. 4, the plates 53 and 54 of the intermediate hinge section 50 straddle the plates 33 and 34 of the body section 30. An upper rivet 55 extends through the outer rear corner portions of the plates 33 and 53 while a lower rivet 56 extends through the outer rear corner portions of the plates 34 and 54. The rivets are generally vertical and support the intermediate hinge section 50 to swing on the body section 30 and about an upright axis.

Figure 8:
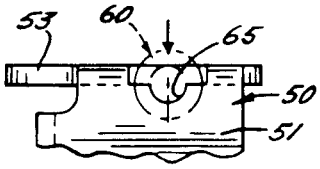
FIG. 8 is a fragmentary elevational view of the intermediate section of the hinge as seen along the line 8—8 of FIG. 7.

Pursuant to the invention, means are provided for hanging the door section 40 of the hinge 20 from the intermediate hinge section 50. Herein, these means comprise a pin 60 (FIG. 7) which projects forwardly from the web 41 of the door section 40 just below the upper screw 42 thereof. The pin includes a shank 61 which is staked to the web 41 and further includes an enlarged head 62 formed integrally with the forward end of the shank. The shank is adapted to be cradled snugly within an upwardly opening and generally C-shaped notch 65 (FIG. 8) formed in the upper edge of the web 51 of the intermediate hinge section 50. When the shank 61 of the pin 60 is located in the notch 65, the head 62 of the pin engages the forward face of the web 51 and holds the web against the forward face of the web 41 of the door section 40.

Figure 7:
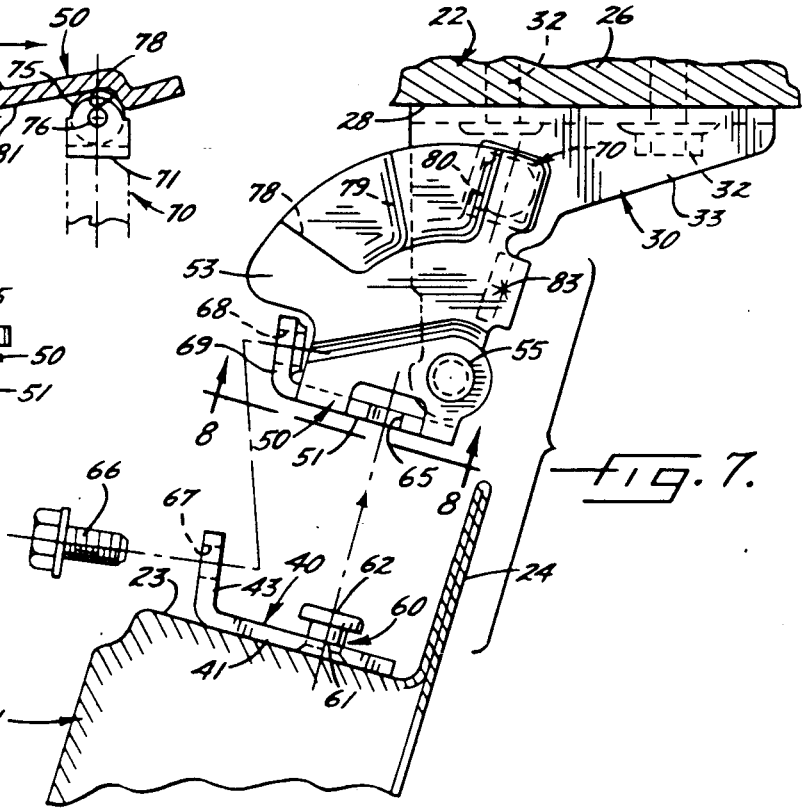
FIG. 7 is a view generally similar to FIG. 3 but shows certain parts of the hinge disassembled to permit removal and re-installation of the door.
Figure 9:
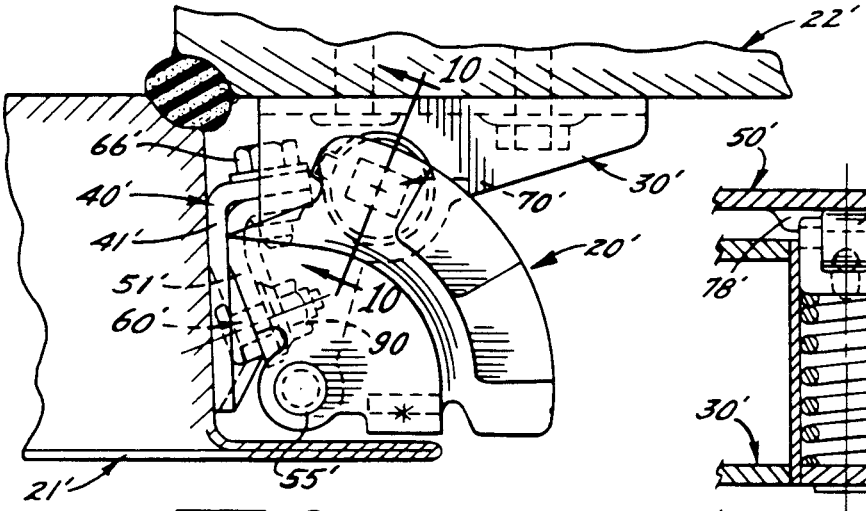
FIG. 9 is another view generally similar to FIG. 1 but shows a further embodiment of a hinge incorporating the features of the invention.
Figure 10:
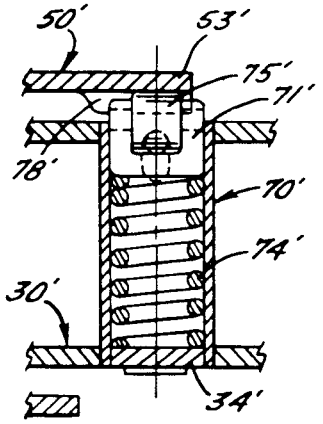
FIG. 10 is a fragmentary cross-section taken substantially along the line 10—10 of FIG. 9.
Figure 11:
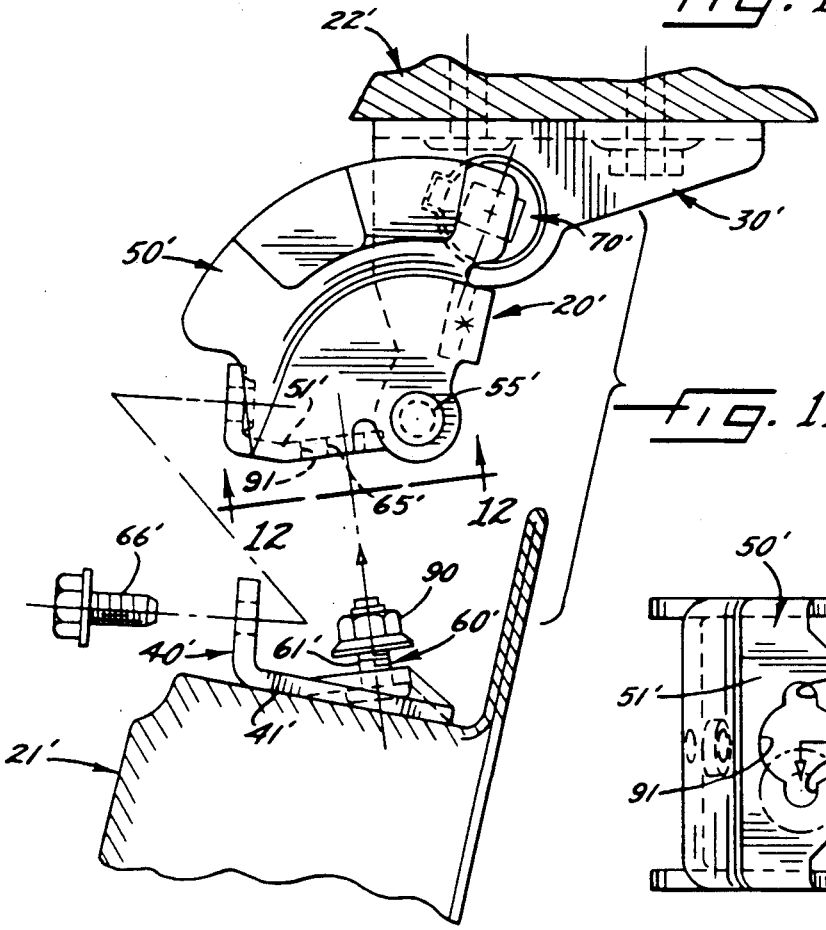
FIG. 11 is a top plan view showing the hinge of FIG. 9 in a nearly fully open position and partially disassembled to permit removal and re-installation of the door.
Figure 12:
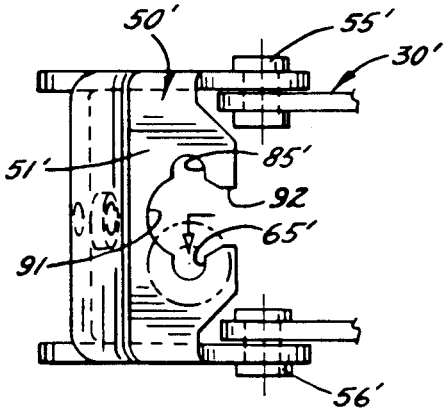
FIG. 12 is a fragmentary elevational view of the hinge of FIG. 11 as seen along the line 12—12 of FIG. 11.

With the foregoing arrangement, the door 21 and the door section 40 may be hung directly from the intermediate hinge section 50 (and indirectly from the body section 30 and body 22) by lowering the pin 60 into the notch 65. When the door is so hung, it may be secured rigidly to the intermediate hinge section 50 by a fastener in the form of a screw 66 (FIGS. 4 and 7). The screw is adapted to extend through a hole 67 in the flange 43 of the door section 40 and is adapted to be threaded into a hole 68 in a forwardly projecting flange 69 formed integrally with the inner edge of the web 51 of the intermediate hinge section 50 and disposed face-to-face with the outer side of the flange 43. The pin 60 and the screw 66 serve to secure the hinge sections 40 and 50 together at two spaced locations and precisely position the door section 40 with respect to the intermediate section 50 and with respect to the body section 30 which is permanently connected to the intermediate section by the rivets 55 and 56.

When the door section 40 is assembled to the intermediate section 50 by the pin 60 and the screw 66, the hinge 20 may be adjusted to establish a proper fit between the door 21 and the body 22 by shifting the hinge sections 30 and 40 relative to the door and body as necessary while the mounting screws 32 and 42 are loose. After the proper fit has been achieved, the screws 32 are tightened to establish a precise positional relationship between the body 22 and the hinge sections 30 and 50 and the screws 42 are tightened to establish a precise positional relationship between the door 21 and the door section 40. Once the screws 32 and 42 have been tightened, the screw 66 may be loosened and removed. By virtue of the pin 60, there is no need to provide extraneous support for the weight of the door during removal of the screw 66. After that screw has been removed, the door may be removed from the body simply by lifting upwardly on the door to dislodge the pin 60 from the notch 65.

When the door 21 is re-installed, it is lowered until the pin 60 seats in the notch 65. The pin coacts with the notch to support the weight of the door and, at the same time, to stabilize the door and effect approximate alinement between the holes 67 and 68 in the flanges 43 and 69. Accordingly, it is a relatively simple matter to re-install the screw 66 and re-assemble the hinge 20 since there is no need to extraneously support the weight of the door or to maneuver the door into an approximate position for re-installation.

From the foregoing, it will be apparent that the present invention brings to the art a new and improved hinge 20 which may be quickly and easily disassembled and re-assembled by virtue of the provision of the intermediate hinge section 50 and by virtue of the coaction of the pin 60 with the notch 65. It will be appreciated, of course, that the pin could be carried by the intermediate hinge section 50 and that the notch could be formed in the door section 40.

According to another aspect of the invention, the hinge 20 is provided with a mechanism 70 (FIGS. 5 to 7) which releasably holds the door 21 in both a partially open position and in a more fully open position and whose components all remain with the body 22 of the vehicle when the door is removed from the body. As a result, there is no need to re-connect or adjust the components of the hold-open mechanism 70 when the door is re-installed.

Figure 5:
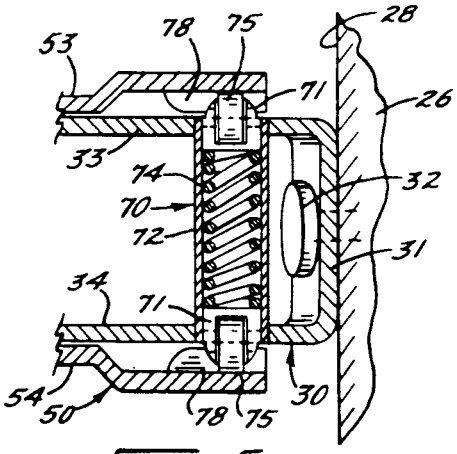

In the embodiment of the hinge 20 shown in FIGS. 1 to 8, the hold-open mechanism 70 includes spring-loaded plunger means having upper and lower vertically spaced plungers 71 (FIG. 5). The plungers are telescoped slidably into the upper and lower end portions of an upright cylindrical sleeve 72 which extends between and is fastened rigidly to the upper and lower plates 33 and 34 of the body section 30. A coil spring 74 is telescoped into the sleeve 72 and is located between the two plungers 71 so as to urge the plungers away from one another. Advantageously, the free end portion of each plunger carries a circular anti-friction roller 75 which is journaled on the plunger by a roll pin 76 (FIG. 6) to turn about an axis extending radially of the hinge axis defined by the rivets 55 and 56.

The hold-open mechanism 70 further includes detent means which coact with the plungers 75 to releasably hold the door 21 in partially open and nearly fully open positions. In the present instance, the detent means are formed on the lower side of the upper plate 53 of the intermediate hinge section 50 and on the upper side of the lower plate 54 of that hinge section. The upper set of detent means is identical to the lower set and thus only the upper set has been illustrated in detail and only the upper set will be described in detail.

Figure 6:
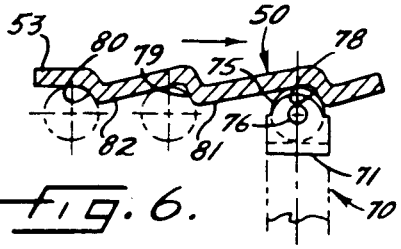

As shown most clearly in FIGS. 5 and 6, the upper set of detent means includes three angularly spaced detents 78, 79 and 80. The detents are defined by generally V-shaped pockets which are formed in the free edge portion of the underside of the upper plate 53 of the intermediate hinge section 50. The detents are created by corrugating the plate and are spaced from one another along an arc whose center lies on the hinge axis defined by the rivets 55 and 56.

The rollers 75 of the plungers 71 are pressed against the free edge portions of the plates 53 and 54 by the spring 74. When the door 21 is fully closed, the rollers seat in the pockets defined by the detents 78 as shown in FIG. 5 and in solid lines in FIG. 6. As the door is opened, each plate 53, 54 swings about the hinge axis and causes the detent 79 to move toward the roller. During such swinging, the roller bears against an inclined ramp 81 (FIG. 6) formed on the plate between the detents 78 and 79. As a result, the spring 74 acts through the plunger 71, the roller 75 and the ramp 81 to exert a force tending to return the door 21 to a closed position.

As the door 21 is opened through a predetermined angle (herein, 45 degrees), each roller 75 seats in the pocket defined by the detent 79. By virtue thereof, closing motion of the door is checked and the door is releasably held against slamming closed from the partially open position shown in FIG. 2.

As opening of the door 21 continues, an inclined ramp 82 (FIG. 6) formed on each plate 53, 54 between the detents 79 and 80 rides across the associated roller 75. Thereafter, the roller seats in the pocket defined by the detent 80. Such seating occurs in the present instance after the door has been opened through an angle of 73 degrees (see FIG. 3) and produces a snubbing action to again releasably hold the door against returning to its closed position.

After the door 21 has been checked at its nearly fully open position, it may be opened through a few more degrees (e.g., 3 degrees) to a completely open position. At this point, vertically projecting lugs 83 (FIG. 7) which are formed integrally with the plates 53 and 54 of the intermediate hinge section 50 engage the edges of the plates 33 and 34 of the body section 30 to stop further opening of the door.

From the foregoing, it will be apparent that all of the components of the hold-open mechanism 70 are mounted solely on the body section 30 and the intermediate section 50 of the hinge 20 and no components are carried by the door section 40. Thus, the components of the hold-open mechanism remain in assembled relation when the door 21 is removed from the body 22 and need not be re-assembled when the door is re-installed. Because of the rollers 75, the action of the hold-open mechanism is relatively quiet and squeak-free. Moreover, the action of the spring-loaded rollers against the inclined ramps 81 and 82 assists in closing the door and reduces the manual effort required to effect such closing. The hold-open mechanism 70 is compact in both the lateral and longitudinal directions and all of its components are compactly stacked within the space between the plates 53 and 54.

As is apparent from FIGS. 1 to 8, virtually all of the parts of the hinge 20 are symmetrical in a vertical sense about an axis extending longitudinally of the vehicle. As a result, the right-hand hinge shown in the drawings may be used as a left-hand hinge simply by inverting the hinge about the longitudinal axis. When the hinge is inverted, a notch 85 (FIG. 4) in the edge of the web 51 opposite the notch 65 opens upwardly and is positioned to receive a pin 60 on the door section 40. The vertical position of the pin 60 on the door section 40 must be changed when the "hand" of the hinge is switched but all other components of the hinge may be used universally.

A modified hinge 20' incorporating the features of the invention is shown in FIGS. 9 to 12 in which parts corresponding to the hinge 20 of the first embodiment are indicated by the same but primed reference numerals. In the hinge 20', the pin 60 is replaced by a bolt 60' (FIG. 11) having a threaded shank 61' adapted to coact with a nut 90. The shank is adapted to be received in an upwardly opening notch 65' (FIG. 12) formed in the lower end of a generally circular opening 91 formed through the web 51' of the intermediate hinge section 50' midway between the upper and lower ends of the web. A slot 92 also is formed in the web 51' and extends from the opening 91 to the outer edge of the web.

In the installed position of the door 21', the shank 61' of the bolt 60' is received within the notch 65', and the nut 90 is tightened to positively clamp the web 51' of the intermediate hinge section 50' against the web 41' of the door section 40'. Such clamping effects a very precise positional relationship between the two sections and compensates for tolerance variations which can exist between the pin 60 and the notch 65 of the hinge 20 of the first embodiment.

To remove the door 21', the nut 90 is loosened but is not removed from the bolt 60'. After the screw 66' has been removed, the door may be lifted upwardly to pull the shank 61' of the bolt out of the notch 65' and then the door may be moved to cause the nut to pass axially through the opening 91 and the slot 92 in the web 51'. A reverse procedure is used to re-install the door. Because the notch 65' of the hinge 20' is located at a higher elevation than the notch 65 of the hinge 20, more nearly balanced turning moments are exerted on the intermediate hinge section 50' when the door is hanging from that section. A downwardly opening notch 85' (FIG. 12) at the upper edge of the opening 91 is adapted to receive the shank 61' of the bolt 60' when the hinge 20' is used as a left-hand hinge.

In the case of the hinge 20', the hold-open mechanism 70' includes only a single plunger 71' (FIG. 10) which herein is an upper plunger having a roller 75' adapted to engage detents 78', 79' and 80' on the lower side of the upper plate 53' of the intermediate hinge section 50'.

The lower end of the spring 74' simply bears against the upper side of the lower plate 34' of the body section 30'.

I claim:

1. A hinge for mounting a door for swinging between open and closed positions on the body of a vehicle, said hinge comprising a door section, an intermediate section and a body section, means for securing said door section and said body section to the vehicle door and body, respectively, pivot means for pivotally connecting said intermediate section to said body section, means for detachably connecting said door section to said intermediate section whereby said door section may be quickly released from and quickly re-attached to said intermediate section to permit the door to be quickly removed from and re-installed on the vehicle body, said last-mentioned means comprising means on said door section and said intermediate section and coacting to cause said door section to hang from said intermediate section while permitting said door section to be lifted off of said intermediate section an lowered into hanging relationship with said intermediate section, said coacting means being spaced laterally from and being independent of said pivot means, and a fastener releasably connecting said door section to said intermediate section at a location remote from said coacting means.

2. A hinge for mounting a door for swinging between open and closed positions on the body of a vehicle, said hinge comprising a door section, an intermediate section and a body section each having an upright web, means for securing the webs of said door section and said body section in face-to-face relation with the vehicle door and body, respectively, pivot means for pivotally connecting said intermediate section to said body section, means for detachably connecting said door section to said intermediate section whereby said door section may be quickly released from and quickly re-attached to said intermediate section to permit the door to be quickly removed from and re-installed on the vehicle body, the web of said intermediate section being disposed face-to-face with the web of said door section an extending substantially perpendicular to the web of said body section when the door section and the intermediate section are connected and when the door is in said closed position, said means for detachably connecting said door section to said intermediate section being spaced laterally from and being independent of said pivot means and comprising a pin anchored rigidly to and projecting generally horizontally from the web of one of said door section and said intermediate section, a vertically opening notch formed in the web of the other of said door section and said intermediate section and receiving said pin whereby said door section hangs from said intermediate section, and a threaded fastener releasably securing said door section to said intermediate section at a location remote from said pin, said pin and said fastener coacting to locate said door section in a precise position on said intermediate section when said fastener is in place and permitting said door section to be lifted off of said intermediate section when said fastener is removed.

3. A hinge as defined in claim 2 in which said pin is anchored to the web of said door section, said notch being an upwardly opening notch formed in the web of said intermediate section.

4. A hinge as defined in claim 3 in which said intermediate section and said door section each include a flange formed integrally with and extending substantially perpendicular to the web of the respective section, said flanges being disposed in face-to-face relation, said fastener comprising a threaded shank which extends through said flanges.

5. A hinge as defined in claim 3 in which said pin comprises a shank and further comprises an enlarged head formed integrally with one end of said shank and engaging the web of said intermediate section when said door section is connected to said intermediate section.

6. A hinge as defined in claim 3 in which said pin comprises a threaded shank and further comprises a nut threaded on said shank, said nut clampingly engaging the web of said intermediate section when said door section is connected to said intermediate section.

7. A hinge as defined in claim 3 in which the web of said intermediate section includes upper and lower edge portions, said notch being formed in the upper edge portion of the web of said intermediate section.

8. A hinge as defined in claim 7 further including a downwardly opening notch formed in the lower edge portion of the web of said intermediate section.

9. A hinge as defined in claim 3 in which the web of said intermediate section includes upper and lower end portions and further includes a side edge extending between said end portions, an opening formed through said web between said end portions and leading out of said side edge, said notch being formed in the lower end portion of said opening.

10. A hinge as defined in claim 9 further including a downwardly opening notch formed in the upper end portion of said opening.

11. A hinge as defined in claim 3 further including a pair of angularly spaced detents on said intermediate section, and a spring-loaded plunger on said body section, said detents successively engaging said plunger as the door is swung toward said open position and being operable when in engagement with said plunger to releasably hold the door against returning to said closed position.

12. A hinge for mounting a door for swinging on the body of a vehicle and for releasably holding the door in a first partially open position and in a second more fully open position, said hinge comprising a door section, an intermediate section and a body section, said door section and said body section being mountable on the vehicle door and body, respectively, means for detachably connecting said door section to said intermediate section whereby said door section may be quickly released from and quickly re-attached to said intermediate section, means for pivotally connecting said intermediate section to said body section and supporting said intermediate section to swing about a predetermined axis relative to said body section, said door section swinging with said intermediate section when said door section is connected to said intermediate section and supporting said door for swinging from a closed position to said first position and then to said second position, first and second detent means on said intermediate section and spaced angularly around said axis, and spring-loaded plunger means on said body section and positioned to engage said first and second detent means as said door section is swung to move the door from said closed position to said first and second positions, respectively, said plunger means being operable when in engagement with said first detent means to releasably hold the door from swinging from said first position toward said closed position and being operable when in engagement with said second detent means to releasably hold the door from swinging from said second position toward said closed position.

13. A hinge as defined in claim 12 in which said door section, said intermediate section and said body section each include an upright web, means for securing the webs of said door section and said body section to the vehicle door and body, respectively, the web of said intermediate section being disposed in face-to-face relation with the web of said door section and extending substantially perpendicular to the web of said body section when the door is in said closed position, a pair of vertically spaced upper and lower plates formed integrally with and projecting from the web of each of said intermediate and body sections, said means for pivotally connecting said intermediate section to said body section comprising pin means extending through the upper and lower plates of said intermediate and body sections, said detent means being located on at least one of said plates of said intermediate section, and said plunger means being located between the plates of said body section and including a plunger bearing against said one plate of said intermediate section.

14. A hinge as defined in claim 12 in which said door section and said intermediate sections include upright webs disposed in face-to-face relation, said means for detachably connecting said door section to said intermediate section comprising a pin anchored rigidly to and projecting from the web of said door section, an upwardly opening notch formed in the web of said intermediate section and receiving said pin whereby said door section hangs from said intermediate section, and a threaded fastener releasably securing said door section to said intermediate section at a location remote from said pin, said pin and said fastener coacting to locate said door section in a precise position on said intermediate section when said fastener is in place and permitting said door section to be lifted off of said intermediate section when said fastener is removed.

15. A hinge as defined in claim 12 in which said intermediate section includes vertically spaced upper and lower plates each having upper and lower sides, said detent means comprising an upper pair of angularly spaced detents on the lower side of said upper plate and further including a lower pair of angularly spaced detents on the upper side of said lower plate and located in underlying alinement with the detents of the upper pair, said plunger means comprising upper and lower plungers located between said plates and biased against said upper and lower plates, respectively.

16. A hinge as defined in claim 15 in which said plunger means further include an upright sleeve located between said plates and secured to said body section, said upper and lower plungers being telescoped slidably into the upper and lower end portions, respectively, of said sleeve, and a spring telescoped into said sleeve and sandwiched between said plungers to urge said upper plunger upwardly and to urge said lower plunger downwardly.

17. A hinge as defined in claim 16 further including an upper roller on the upper end of said upper plunger, a lower roller on the lower end of said lower plunger, said upper and lower rollers being engageable with said upper and lower plates, respectively, and means journaling each roller on its respective plunger to rotate about an axis extending transversely of said predetermined axis.

18. A hinge as defined in claim 12 in which said intermediate section comprises vertically spaced upper and lower plates having opposing sides, said detent means comprising first and second angularly spaced detents formed on one of said plates on the side thereof opposing the other plate, said plunger means comprising an upright sleeve secured to said body section and located substantially between said plates, a single plunger telescoped into said sleeve and having an end portion projecting axially from said sleeve, and a spring located in said sleeve and biasing said end portion of said plunger against said one plate and the detents thereon.

19. A hinge as defined in claim 18 in which said upper end portion of said plunger includes a roller engageable with said one plate and the detents thereon, and means journaling said roller on said plunger to rotate about an axis extending transversely of said predetermined axis.

* * * * *